United States Patent [19]

Vatsky

[11] 4,206,712

[45] Jun. 10, 1980

[54] FUEL-STAGING COAL BURNER

[75] Inventor: Joel Vatsky, Millburn, N.J.

[73] Assignee: Foster Wheeler Energy Corporation, Livingston, N.J.

[21] Appl. No.: 920,295

[22] Filed: Jun. 29, 1978

[51] Int. Cl.[2] ..... F23K 5/00

[52] U.S. Cl. ..... 110/264; 110/261; 431/183; 431/284

[58] Field of Search ..... 110/263, 264, 265, 260, 110/261, 262; 431/284, 181, 182, 183, 188

[56] References Cited

U.S. PATENT DOCUMENTS

| | | | |
|---|---|---|---|
| 1,163,650 | 12/1915 | Fogler | 110/264 |
| 2,118,600 | 5/1938 | Frisch | 110/104 |
| 2,823,628 | 2/1958 | Poole et al. | 110/264 |
| 3,049,085 | 8/1962 | Musat et al. | 431/284 X |
| 3,145,670 | 8/1964 | Copian et al. | 431/284 X |
| 3,256,842 | 6/1966 | Vigneroh et al. | 431/284 X |
| 3,393,650 | 7/1968 | Daman et al. | 110/261 |
| 3,918,834 | 11/1975 | Sigal et al. | 431/10 |
| 4,147,116 | 4/1979 | Graybill | 110/263 |

FOREIGN PATENT DOCUMENTS 908055 4/1954 Fed. Rep. of Germany .

*Primary Examiner*—Edward G. Favors
*Attorney, Agent, or Firm*—Marvin A. Naigur; John E. Wilson; John J. Herguth, Jr.

[57] ABSTRACT

A fuel-staging burner assembly and method in which a burner nozzle has separate, concentrically disposed elements to burn coarse and fine coal particles under different combustion conditions to reduce the production of nitrogen oxides from the combustion of coal as a fuel. The burner assembly further includes a control nozzle for maintaining a swirling motion in the combustion flame and a separate, axially-movable adjustable sleeve for regulating the quantity flow of turbulence-free combustion-supporting air.

7 Claims, 4 Drawing Figures

FUEL-STAGING COAL BURNER

BACKGROUND OF THE INVENTION

This invention relates generally to a burner assembly and, more particularly, to an improved burner assembly and method which operate in a manner to reduce the formation of nitrogen oxides as a result of fuel combustion.

Considerable attention and efforts have recently been directed to the reduction of nitrogen oxides resulting from the combustion of fuel, and especially in connection with the use of coal in the furnace sections of relatively large installations such as vapor generators and the like. In the burning of coal, nitrogen oxides are formed by the fixation of atmospheric nitrogen available in the combustion-supporting air, and is a function of the flame temperature. When the flame temperature exceeds 2800°, the amount of fixed nitrogen removed from the combustion-supporting air rises exponentially with increases in the temperature. Nitrogen oxides are also formed from the fuel-bound nitrogen available in the fuel itself, which is not a direct function of the flame temperature, but is related to the quantity of available oxygen during the combustion process.

In a typical arrangement for burning coal in a vapor generator, for example, one or more burners are usually disposed in communication with the interior of the furnace, and operate to burn a mixture of air and pulverized coal. The burners used in these arrangements are generally of the type in which a swirling fuel and air mixture is continuously injected through a single nozzle so as to form a single, relatively large flame. As a result, the surface area of the flame is relatively small in comparison to its volume, and therefore the average flame temperature is relatively high. This condition leads to the production of high levels of nitrogen oxides in the final combustion products, which cause severe air pollution problems.

Since the formation of nitrogen oxides increases with increases in the burner temperatures, attempts have been made to supress the latter temperatures and thus reduce the formation of nitrogen oxides. Attempted solutions have included techniques involving two stage combustion, flue gas recirculation, the introduction of an oxygen-deficient fuel-air mixture to the burner and the subsequent introduction of additional combustion-supporting air exteriorally of the burner itself, and the breakup of a single, large flame into a pluraity of smaller flames. However, these attempts have often resulted in added expense in terms of increased construction costs, and the like, and have lead to other related problems, such as the production of soot and complex mechanisms to achieve the solutions.

Heretofore, registers positioned within a windbox disposed adjacent to a lower portion of the furnace have been used to jointly control the volume flow and the turbulence of the secondary combustion-supporting air from the windbox to support the burning of coal. These registers, which generally comprise mechanically-complex assemblies of rotatable vanes and associated control mechanisms, are designed primarily to induce turbulence, or swirl, in the flow of the mixture of fuel and combustion-supporting air. Secondarily, these registers were designed as damper or flow volume control devices. However, depending upon the operating condition, existing registers only function with one degree of control. That is, if they are operating in the closed-down, or slightly open condition, they function primarily as a damper to control the quantity flow of combustion-supporting air through the register and through the burner assembly. On the other hand, if they are operating at larger openings, the dampening effect achieved by further opening of the register is considerably reduced. At the more fully open conditions, however, relatively more swirl is induced in the flow of the combustion-supporting air by only slight changes in the opening of the register. Thus, the prior art registers either function effectively as dampers or as turbulence creating devices, but do not function with equal effectiveness in both modes. The large numbers of components associated with the prior art registers also present problems of reliability.

SUMMARY OF THE INVENTION

It is, therefore, an object of the present invention to provide an improved burner assembly and method which operate in a manner to considerably reduce the production of nitrogen oxides in the combustion of coal, without any significant increase in costs, or other related problems.

Another object of the present invention is to provide an improved burner assembly and method of the above type in which the stoichiometric combustion of the fuel is regulated to reduce formation of nitrogen oxides.

A further object of the present invention is to provide an improved burner assembly and method of the above type for controlling the turbulence and flow of the combustion-supporting air provided to the burner assembly.

Yet another object of the present invention is to provide an improved burner assembly and method of the above type with improved means for separately regulating the quantity flow of the combustion-supporting air, and for controlling the turbulence of this flow.

It is a more specific object of the present invention to provide a burner assembly having a minimum of moving parts and which, in operation, greatly reduces the production of nitrogen oxides. The fuel coal particles are separated into two separate fractions and burned in different components of the burner assembly under different conditions which result in the minimum production of nitrogen oxides. Improved means are provided for introducing a conditioned fluid into the burner assembly to induce turbulence in the burning coal flame, and separate means are provided to regulate the turbulence-free flow of secondary air.

Toward the fulfillment of these and other objects, the burner assembly of the present invention includes a burner nozzle having an inner tubular element disposed within an outer shell element, with both elements being disposed within a control annulus supplied with tempered air to induce controlled turbulence in the combustion flame. A separator supplies coarse and fine coal fractions mixed with primary air, respectively, to the inner and shell elements of the burner nozzle. Tempered air and recirculated flue gas are supplied to the inner element to devolatize the coarse coal fraction under reducing conditions, and the fine coal fraction is devolatized under conditions of low excess air. An axially-movable tubular sleeve regulates the flow of combustion-supporting secondary air to the burner assembly.

BRIEF DESCRIPTION OF THE DRAWINGS

The above description, as well as further objects, features, and advantages of the present invention, will be more fully appreciated by reference to the following description of a presently-preferred but nonetheless illustrative embodiment in accordance with the present invention, when taken in connection with the accompanying drawings, wherein.

DESCRIPTION OF THE PREFERRED EMBODIMENTS

Figure 1:
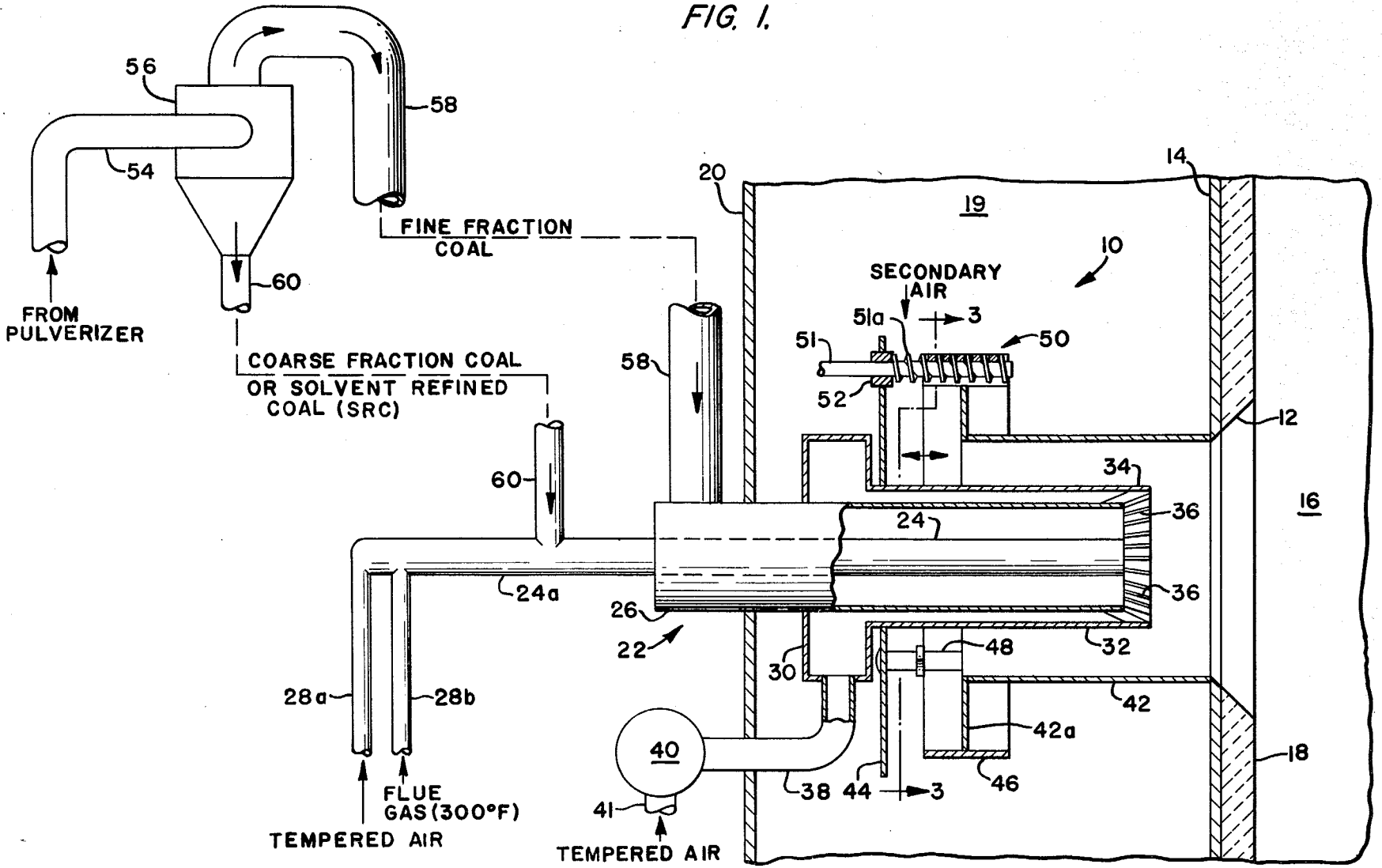
FIG. 1 is a schematic view, with some of the structure shown in section, showing the burner assembly of the present invention in conjunction with a furnace and a fuel supply system.

Referring more specifically to FIG. 1 of the drawings, a burner assembly 10 is disposed in axial alignment with an opening 12 formed in a front wall 14 of a conventional furnace. While not specifically shown, it is understood that a back wall disposed in parallel with the front wall 14, and sidewalls cooperate with the front wall to define a combustion chamber 16. The inner surface of the wall 14 as well as the other walls of the combustion chamber, are lined with an appropriate thermal insulation material 18, and while not specifically shown, it is understood that the combustion chamber 16 is also lined with vertically extending boiler tubes through which a heat exchange fluid, such as water, is circulated in a conventional manner. The heat produced in the combustion chamber 16 heats the water in the boiler tubes, producing a mixture of steam and water which rises in the tubes.

A windbox 19, defined by a front wall 20 disposed in a spaced, substantially paralled relationship with the furnace wall 14, and which cooperates with spaced top and bottom walls and spaced sidewalls (not shown), forms a plenum chamber for receiving the combustion-supporting air introduced by conventional means (not shown).

The burner assembly 10 includes a burner nozzle 22 having an inner tubular element 24 disposed concentrically within a larger-diameter, outer shell element 26. The end portions of the tubular element 24 and the shell element 26 disposed within the windbox 19 are substantially coextensive longitudinally, as shown in FIG. 1, and the other end portions of these structures extend beyond the wall 20 of the windbox. An extension **24*a* of the inner element 24 extends beyond the wall 20, and is connected at its exterior end to pipes 28*a* and 28*b*, which supply tempered air and flue gas, respectively, from appropriate sources. For example, the pipe 28*a* carrying the tempered air may be connected to an air preheater (not shown) and be provided with means for mixing the preheated air with the cooler ambient air to provide tempered air of 200°–300° F., while the pipe 28*b*** carrying the flue gas may be connected to the exhaust section of the furnace to provide flue gas at approximately 600° F.

Disposed around the portion of the burner nozzle 22 which extends within the windbox 19, adjacent to the wall 20, is a plenum 30 of circular configuration and a tubular control air annulus 32 which extends substantially the length of the burner nozzle within the windbox. The control air annulus 32 terminates in a control air nozzle 34 which is provided with a pluraity of circumferentially disposed and radially directed slots 36. The slots 36 induce swirling of the air discharged from the control air annulus 32, as will be described more fully below. Conveniently, and as an example only, the slots 36 may be provided by simply being cut in the peripheral surface of the control air nozzle 34. Alternatively, the swirling motion in the air flowing from the control air annulus 32 may be induced by a plurality of radially disposed vanes (not shown) appropriately secured to the surface of the tip of the control air nozzle 34.

A connector pipe 38 extends through the wall 20 and provides fluid communication between the circular plenum 30 and a manifold 40 disposed exteriorly of the windbox 19. The manifold 40, in turn, is connected to a pipe 41 through which tempered air is supplied to the manifold. The source of tempered air for the pipe 41 may be the same as for the pipe **28*a* described above. It is understood that a plurality of burner assemblies 10 would be disposed within the windbox 19 to direct fuel into the combustion chamber 16, and the manifold 40** would provide a common source of tempered air to each of the burner assemblies.

Disposed concentrically around the control air annulus 32 is a circular duct 42 having one end appropriately attached around the opening 12 of the furnace wall 14. The other end of the duct 42 is provided with a circumferential collar **42*a*, and a circular plate 44, centrally perforated to permit passage therethrough of the control air annulus 32 and the burner nozzle 32, is disposed in a spaced, parallel relationship to the collar. The space between the collar 42*a* and the circular plate 44 defines a passage through which combustion-supporting air, commonly called secondary air, flows from the windbox 19 into the combustion chamber 16 through the interior of the duct 42**.

Figure 2:
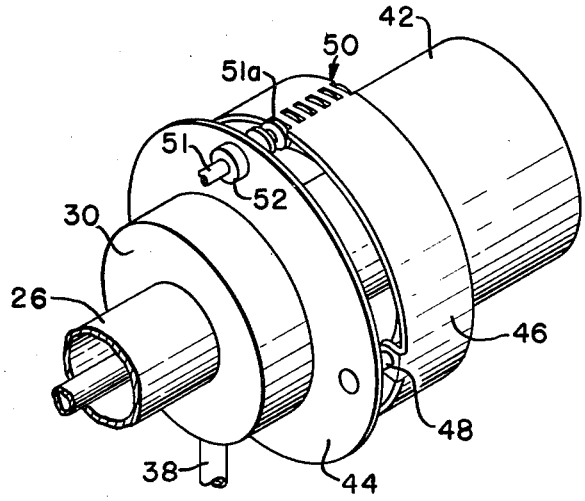
FIG. 2 is a pictorial, perspective view, with some of the structure shown in section, showing the air flow regulator structure of the burner assembly.

The quantity flow of the secondary air through the burner assembly 10 is controlled by movement of a tubular sleeve 46 which is slidably disposed on the perphiery of the collar **42*a*, and is movable parallel to the longitudinal axis of the burner nozzle 22 and the duct 42. The tubular sleeve 46 is of a length, in its longitudinal direction, which is somewhat greater than the distance between the circular plate 44 and the collar 42*a* so that when the tubular sleeve is positioned to enclose the passage between the plate and the collar, a portion of the tubular sleeve extends beyond the collar 42*a* to act as a fluid seal to prevent the leakage of secondary air into the combustion chamber 16. FIGS. 1 and 2 shown the sleeve 46 approximately midway between the open and closed positions. It is understood, of course, that while not specifically described, additional sealing means may be provided for the tubular sleeve 46 if necessary to prevent leakage of the secondary air from the windbox into the burner assembly 10 and the combustion chamber 16**.

Figure 3:
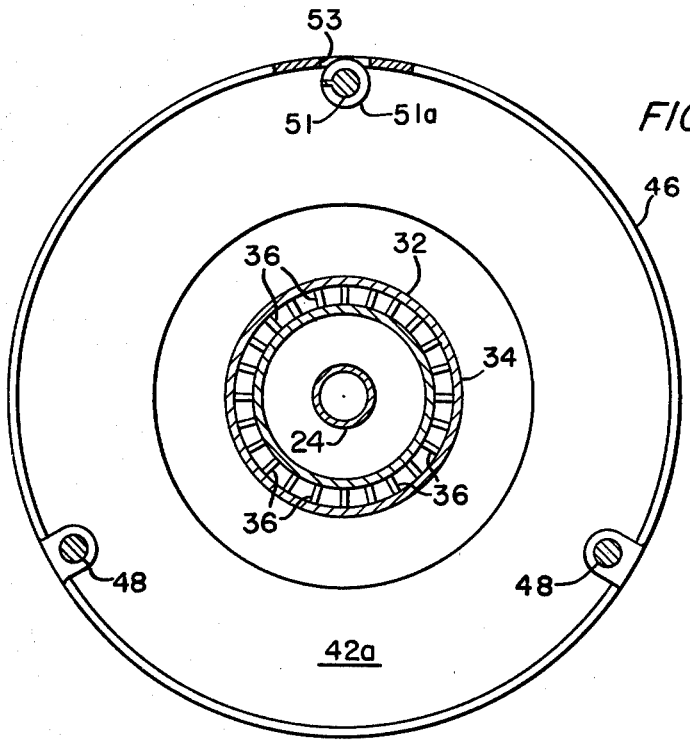
FIG. 3 is a cross-sectional view taken along the line 3—3 of FIG. 1.

The longitudinal movement of the tubular sleeve 46 is guided by a pair of sleeve guide rods 48 which are suitably supported on the circular plate 44 and appropriately positioned around the circumference of the plate and the tubular sleeve. This orientation can be seen more clearly in FIGS. 2 and 3.

Figure 4:
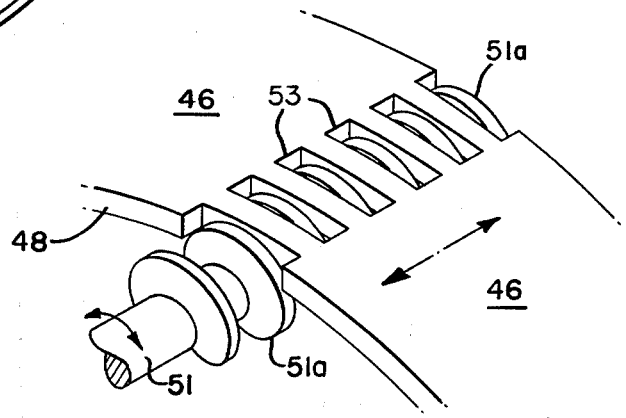
FIG. 4 is an enlarged, partial elevational view of a portion of the air flow regulator of FIG. 2.

A drive mechanism 50 is provided to control the longitudinal movement of the tubular sleeve 46, and includes an elongated worm gear 51 having one end portion suitably connected to an appropriate drive means (not shown) for rotating the worm gear, and the other end provided with threads 51*a*. The worm gear 51 extends through a bushing 52, which is attached to the circular plate 44 to provide rotatable support for the worm gear. As better shown in FIGS. 2 and 4, the threads 51*a* of the worm gear 51 mesh with a plurality of apertures 53 provided in the tubular sleeve 46, such that upon rotation of the worm gear, the tubular sleeve is caused to move longitudinally with respect to the longitudinal axis of the burner assembly 10. In this manner, the quantity flow of combustion-supporting air through the burner assembly 10 is controlled by the axial displacement of the tubular sleeve 46, and only two moving components are thus incorporated in the burner assembly, which are the rotatable worm gear 51 and axially-movable tubular sleeve 46.

With reference to FIG. 1 the coal fuel which has been crushed and mixed with a pneumatic transport medium, such as air, is supplied from a conventional pulverizer (not shown) by means of a supply conduit 54, to a separator-classifier apparatus 56, such as a cyclone separator, in which the fine particles of coal are separated from the coarse coal particles. The fine particles of coal, or the fine fraction coal, which is less than 40% of the total pulverized coal flow, together with about 90% of the primary or pneumatic transport air is removed from the separator 56 through the fuel pipe 58 and is introduced into the shell element 26 of the burner nozzle 22. The coarse coal particles, or coarse fraction coal comprising approximately 60%, of the total pulverized coal flow, fall from the separator into a fuel pipe 60, which introduces the coarse coal particles and the remaining quantity of primary air into the extension 24*a* of the inner element 24. The ratio of the fine coal particles to the coarse coal particles may be varied, and is generally determined by the efficiency of the cyclone separator 56. Tempered air from the pipe 28*a* and recirculated flue gas from the pipe 28*b*, in a controlled variable ratio, are forced into the extension 24*a* to entrain the coarse coal particles and carry it into the combustion chamber 16 through the inner element 24 of the burner nozzle 22. The flow of tempered air and flue gas is not used to control swirling of the air flow from the control air annulus 32, but serves primarily to carry the coarse coal fraction to the combustion chamber 16. The ratio of the tempered air to the recirculated flue gas is adjusted to maintain the desired degree of "richness" of the coarse coal stream, or the concentration of the coarse coal particles with respect to the quantity oxygen contained in the entraining mixture of fluids.

In operation, pulverized coal suspended or entrained within the primary air is supplied from a conventional coal pulverizer to the cyclone separator 56. In the separator 56, the fine and coarse coal particles are separated, respectively, into the fine fraction coal and the coarse fraction coal in the manner described above, and the separated coal is introduced into the shell element 26 and the inner element 24, respectively, of the burner nozzle 22. The tubular sleeve 46 is properly positioned by operation of the drive mechanism 50 in the manner described above, to provide the correct flow of secondary air from the windbox 19. The tempered control air for maintaining a turbulent region around the burning coal is introduced through the control air nozzle 34 from the manifold 40, the circular plenum 30, and the control air annulus 32. The pulverized coal flowing through the shell element 26 and the inner element 24 of the burner nozzle 22 is ignited by suitable ignitors (not shown) appropriately positioned with respect to the burner nozzle 22. These ignitors are shut off after steady-state combustion has been achieved.

The fine fraction coal within the shell element 26 of the burner nozzle 22 has a high surface area per unit volume, and will rapidly devolatilize in a region which has a stoichiometry less than 100%. Since less than 40% of the total fuel is being supplied through the shell element 26 and since approximately 90% of the primary air flowing through the shell constitutes only 20% of the total combustion-supporting air directed into the combustion chamber 16, the resulting stoichiometric ratio is less than 100%, and is on the order of 70%. The rapid devolatilization of the fine fraction coal under conditions of low excess air promotes low nitrogen oxides formation in the burning of the fine fraction coal. The flame front is maintained at the tip of the burner nozzle 22 by controlling the degree of turbulent mixing between the fine coal fraction issuing from the tip of the shell element 26 and the secondary air stream flowing through the control air annulus 32, as will be described more fully below.

The inner element 24 of the burner nozzle 22 has a fuel-rich mixture of coarse coal particles and approximately 10% of the primary air. The temperature in the inner element 24 is maintained between 300° F. and 600° F. by varying the temperatures and ratios of the tempered air and the recirculated flue gas provided through the pipes 28*a* and 28*b*, respectively, thereby initiating devolatilization of the coarse coal fraction within the inner element. As the coarse coal fraction passes from the inner element 24, it is rapidly heated by the surrounding flame produced by the burning fine faction coal stream, which is under intense reducing conditions. Complete devolatilization then rapidly occurs, and combustion of the remaining char, or char burn out, is initiated. The coarse coal fraction is thus devolatilized under intense reducing conditions, which results in very low production of nitrogen oxides. In the near-throat region of the flame, or that portion of the flame within the opening 12 of the furnace wall 14, the inner portion of the coal stream passing therethrough is pyrolyzed as the volatile fraction of the coal is driven off as a low BTU gas, which expands outwardly radially into the fine coal fraction flame region, where it burns with a low flame temperature.

In order to maintain a turbulent region around the tip of the burner nozzle 22 adjacent to the opening 12 and therefore provide for flame stability, a small quantity of high-pressure, high-velocity control air is directed at the fuel steam through the control air nozzle 34. This quantity of air can be varied from between 5% to 15% of the total amount of combustion-supporting air. Tempered air is supplied via a known booster fan (not shown) to the manifold 40, which supplies a plurality of burner assemblies 10. This preheated control air flows from the manifold 40 to the circular plenum 30 and through the control air annulus 32. The control air is then directed at the fuel stream by the control air nozzle 34, which imparts spin to the control air to create the desired turbulent flow within the fuel flow stream. The spin momentum imparted by the control air is varied by regulating the pressure and quantity of the control air supplied through the control air annulus 32.

An improved fuel-staging coal burner assembly and method have thus been described which greatly reduces the production of nitrogen oxides from the combustion of coal as fuel, and which has a minimum of moving components in the burner assembly. In the burner assembly described above, the emission of nitrogen oxides is controlled by the separation of the pulverized fuel coal from the carrier or primary air into a coarse coal fraction and a fine coal fraction having a concentrated and a diluted flow stream, respectively, with regard to the amount of coal particles and the available primary air. This separation and staging of the fuel coal reduces the emission of nitrogen oxides since most of the available oxygen in the carrier air is removed from a good portion of the coal in the initial stages of combustion of the coal. Secondly, by reducing or controlling the degree of turbulence around the flame front, the amount of available oxygen for the fixation of nitrogen into nitrogen oxides is also reduced to reduce the production of such oxides.

By the use of tempered air and recirculated flue gas in the shell element of the burner nozzle, the devolatilization process, in which the volatile fraction of the coarse coal particles is driven off before the coal enters the actual flame zone, also effectively reduces the formation of nitrogen oxides. Since a large portion of the available nitrogen bound in the fuel is bound in the volatile substances, and if the volatile fraction is driven off and burned as a low BTU gas before the coal is burned, then the nitrogen in the volatile substance is converted to molecular nitrogen, which is the same as the molecular nitrogen found in the atmosphere.

The use of tempered air with the disclosed burner assembly provides the additional capability of burning solvent refined coal (SRC) in the burner nozzle. Solvent refined coal is a processed coal having a higher heating value than raw coal with a very low sulfur content and producing little ash when burned. The coal is processed by dissolving it in a suitable solvent, heating the solution under pressure to drive off the solvent and the sulfur as hydrogen sulfide, and solidifying the processed coal. SRC has a lower melting point and is normally burned in a water-cooled, jacketed burner to prevent plugging of the burner nozzle. With the present nozzle, use of the tempered air prevents plugging by the SRC and eliminates the need for a separate burner cooling system.

The variation of the stoichiometric ration of the burning fuel with respect to the axis of the above-disclosed burner assembly is as follows. Along the centerline, where the coarse coal fraction mixed with recirculated flue gas and tempered air begins to burn, a very low stoichiometric-ratio condition exists, on the order of 5–25%. This means that there is very little oxygen available for the formation of nitrogen oxides since the coal fraction is essentially undergoing a gasifying process, in which the violatile substances are driven off as a low-BTU gas. Further radially from the centerline, in the region where the fine coal fraction is burning, a 60–90% stoichiometric ratio condition exists, which produces little or no nitrogen oxides. Yet further radially is the zone of the secondary air flow, which has no fuel. This is completely axial flow, with little or no induced turbulence. This axial flow does not mix with coal stream until the stream is in the combustion chamber of the furnace.

Thus, the operation of the disclosed burner assembly results in greatly reduced emission of nitrogen oxides by the combination of two factors: (1) greatly reducing or eliminating the available oxygen which would normally result in a high emission of nitrogen oxides; and (2), at the same time, causing a partial gasification of the fuel coal, or initiating the devolatilization of the coal, under a condition of very-reducing atmosphere.

While the means for achieving the reduction of nitrogen oxides emission has been disclosed with particular reference to the above-described burner nozzle assembly, the method may be employed with equal effectiveness with other nozzle designs. Similarly, while the burner nozzle assembly has been described as having a separate turbulence-inducing control nozzle and a substantially turbulence-free air flow control sleeve resulting in an improved burner nozzle design having a considerably reduced number of moving parts disposed within the windbox, the disclosed burner nozzle assembly could also be used with a standard, conventional register, such as those having a circular array of rotatable vanes.

As noted above, the prior-art register functions effectively either as a damper or as a turbulence-creating device, but does not function with equal effectiveness in both modes. With the present design of the burner assembly, two degrees of control are always provided under all operating conditions. Thus, the desired turbulence induced in the flame front can be regulated independently of the dampening effect by separate variations of the pressure and flow rate of the control air through the circular plenum and the control air annulus, and the angular orientation of the slots or vanes provided in the control air nozzle. Regulation of the secondary, or combustion-supporting, air from the windbox is controlled independently of and has little effect on the creation and control of the air turbulence. The quantity and flow rate of the secondary air through the burner assembly and into the combustion chamber is regulated by the axial movement of the tubular sleeve, and this flow is substantially axial, with little or no turbulence induced in its flow. Separation of these two functions, and the regulation of the secondary air from the windbox is achieved in an apparatus with only two moving parts, to wit, the rotatable driving worm gear, and the axially-movable tubular sleeve.

It is understood of course that while the disclosed air control and turbulence control means have been disclosed in use with the improved fuel-staging burning assembly, the air and turbulence control means could be used together or individually with equal effectiveness with other types of fuel burner nozzles.

Although not particularly illustrated in the drawings, it is understood that all of the components described above are arranged and supported in an appropriate fashion to form a complete and operative system. It is further understood that all ancillary components, such as motors, pumps, fans, fuel sources, connecting conduits, etc., have not been specifically described, but such components are known in the art and would be appropriately incorporated into the operative system.

Of course, variations of the specific construction and arrangement of the fuel-staging burner assembly and the method for use disclosed above can be made by those skilled in the art without departing from the invention as defined in the appended claims.

I claim:

1. A fuel-staging burner assembly for use with pulverized coal with separate fractions of the coal being burned under different stoichiometric conditions to reduce the production of nitrogen oxides, comprising:

a burner nozzle adapted for operative attachment to a combustion chamber and including:

a tubular element for receiving a mixture of coarse particles of pulverized coal mixed with carrier primary air;

conduit means coupled to said tubular element for introducing a heated gas to said tubular element to initiate devolatilization of said coarse coal particles; and a shell element disposed concentrically about said tubular element for receiving a mixture of fine particles of pulverized coal mixed with carrier primary air;

means coupled to a source of fluid and disposed in operative relationship to said tubular and said shell elements for directing a swirling flow of fluid at the outlets of said tubular and said shell elements to maintain controlled turbulence of the combustion flame; and flow control means for regulating the flow of substantially turbulence-free combustion supporting air to said burner nozzle, whereby said mixture of fine particles is rapidly devolatilized in said shell element to achieve low nitrogen oxides formation, and said mixture of coarse particles is partially devolatilized in said tubular element and discharged into the surrounding flame produced by said mixture of fine particles, with said mixture of coarse particles being rapidly heated under intense reducing conditions, resulting in combustion with low production of nitrogen oxides.

2. The burner assembly of claim 1, wherein said flow control means includes:

a duct disposed concentrically about said shell element for conducting combustion supporting air to said burner nozzle;

a pair of substantially-parallel, spaced members operatively connected to said duct and defining a flow passage between the spaced members;

a tubular sleeve slidably disposed with respect to said spaced members and movable to vary the size of the flow passage; and means for selectively slidably moving said tubular sleeve.

3. The burner assembly of claim 2, wherein said means for slidably moving said tubular sleeve includes:

a plurality of spaced perforations disposed on said tubular sleeve; and screw means rotatably disposed in operative engagement with said perforations, whereby rotation of said screw means causes movement of said tubular sleeve axially relative to the longitudinal axis of said sleeve.

4. The burner assembly of claim 1, wherein said means for directing the swirling flow includes:

a tubular annulus disposed concentrically about said shell element and having one outlet disposed adjacent to the outlets of said tubular and said shell elements;

coupling means connecting said annulus to a heated fluid; and a plurality of radially-extending guide members disposed on the outlet of said annulus for directing the flow of heated fluid from said annulus in a swirling configuration.

5. The burner assembly of claim 4, further including a plenum chamber in fluid communication with said tubular annulus, and said coupling means is in fluid communication with said plenum chamber.

6. The burner assembly of claim 4, wherein said guide members comprise a plurality of slots provided on the outlet of said annulus.

7. The burner assembly of claim 4, wherein said guide members comprise a plurality of vanes provided on the outlet of said annulus.

* * * * *